United States Patent [19]

Jensen

[11] 4,339,036

[45] Jul. 13, 1982

[54] CONTAINER VENTING ARRANGEMENT

[75] Inventor: James R. Jensen, Fremont, Calif.

[73] Assignee: Container Corporation of America, Chicago, Ill.

[21] Appl. No.: 217,903

[22] Filed: Dec. 18, 1980

[51] Int. Cl.[3] ..... B65D 85/50; B65D 51/16

[52] U.S. Cl. ..... 206/423; 206/628; 220/367; 229/6 A; 229/23 R; 229/43; 229/DIG. 14

[58] Field of Search ..... 229/DIG. 14, 6 A, 23 R, 229/16 R, 17 R, 30, 43; 426/118, 106; 206/45.26, 423, 628; 217/42; 220/367, DIG. 27

[56] References Cited

U.S. PATENT DOCUMENTS

| | | | |
|---|---|---|---|
| 2,919,020 | 12/1959 | McCleary | 206/628 |
| 3,019,944 | 2/1962 | Nelson et al. | 206/628 |
| 3,085,733 | 4/1963 | Umanoff | 229/17 R |
| 4,163,494 | 8/1979 | Stollberg | 229/6 A |
| 4,176,745 | 12/1979 | Stollberg | 206/423 |

*Primary Examiner*—William Price
*Assistant Examiner*—Gary E. Elkins
*Attorney, Agent, or Firm*—Richard W. Carpenter; Davis Chin

[57] ABSTRACT

A venting arrangement for a container having telescoping tray and cover members with aligned openings. The tray member includes a pair of lock tabs formed in a side wall and adapted for movement outwardly from the plane thereof to provide vent openings therein. The tray member also includes a pair of access tabs formed in the side wall to provide openings for finger access to the lock tabs. The cover member has a cover slot consisting of a first section and a second section which are foldable at an angle to each other. The lower edges of the second section are disposed within the side wall vent openings and are securely engageable with the lock tabs to maintain the cover flap in open position.

3 Claims, 8 Drawing Figures

CONTAINER VENTING ARRANGEMENT

SUMMARY OF THE INVENTION

This invention relates to shipping containers, and more particularly to shipping containers having vent openings for ventilating the contents of the container. Containers of this type are used in the shipping of produce, floral, and other items requiring ventilating before or during shipment.

Venting arrangements per se are known in the field of produce containers. One example of such arrangement may be found in U.S. Pat. No. 4,176,745.

It is an object of the present invention to provide an improvement over structures of the prior art, which improvement includes an arrangement with a pair of walls each having flaps which are foldable out of the plane of the walls to provide aligned openings wherein one of the flaps serves to lock the other flap into an open position.

A more specific object of the invention is the provision, in an arrangement of the type described, of additional access openings which make it easier to reach into a filled container and open the flaps to provide for such venting.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
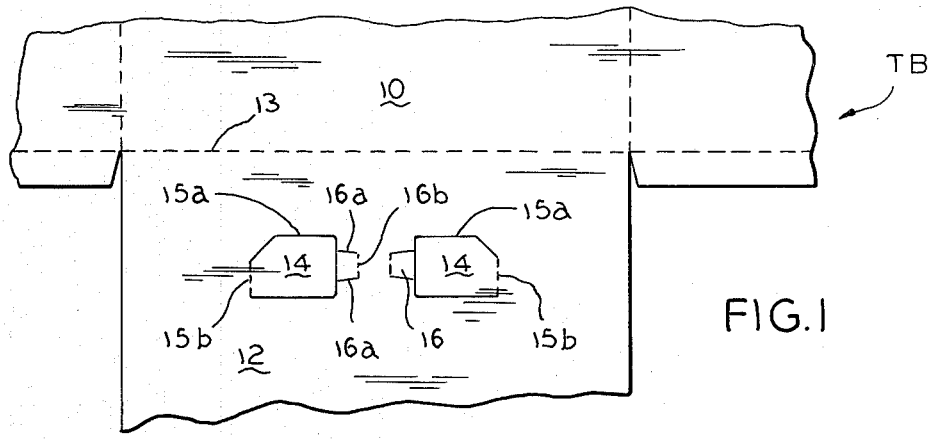
FIG. 1 is a fragmentary plan view of a portion of a blank from which a container tray embodying features of the invention may be formed.
Figure 2:
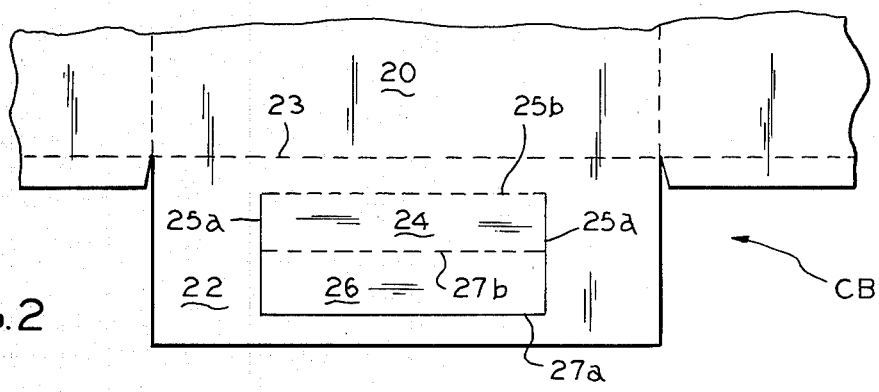
FIG. 2 is a view similar to FIG. 1 but illustrating a portion of a telescoping container cover blank embodying features of the invention.
Figure 3:
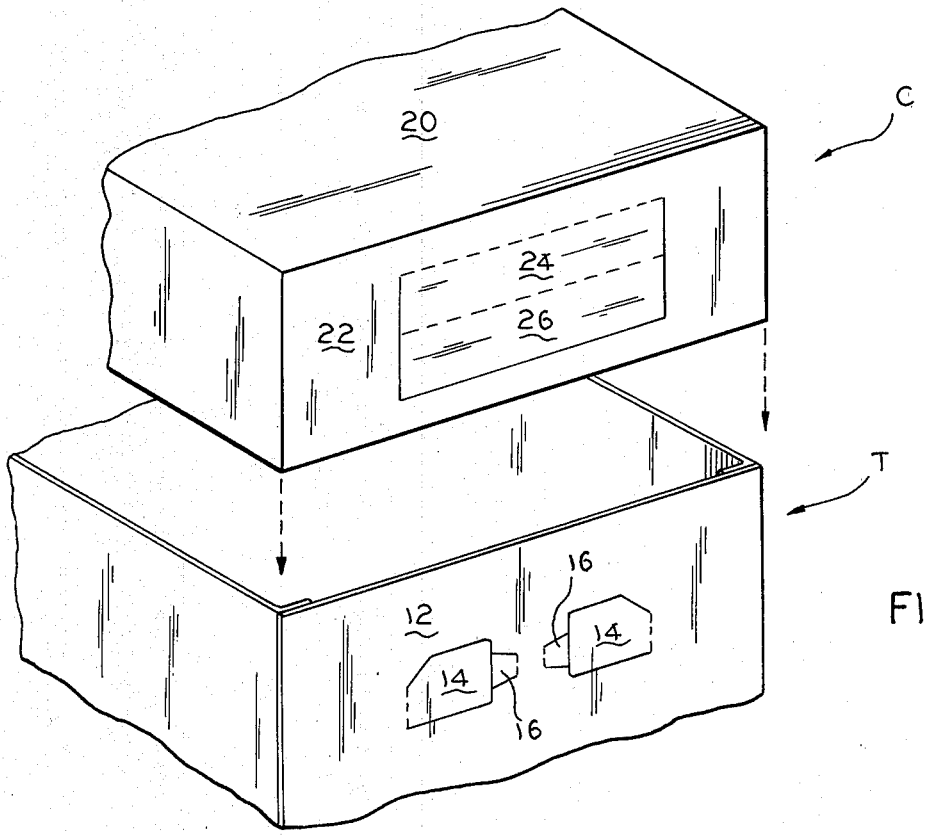
FIG. 3 is a fragmentary perspective view illustrating the container tray and cover, each in closed position prior to placing in telescoping relationship.
Figure 4:
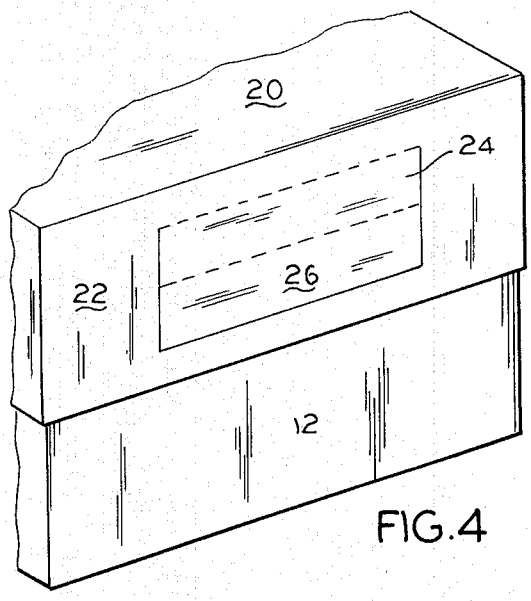
FIGS. 4 through 8 are views similar to FIG. 3 but illustrating the steps by which the container tray and cover venting flaps are utilized in the venting arrangement.
Figure 5:
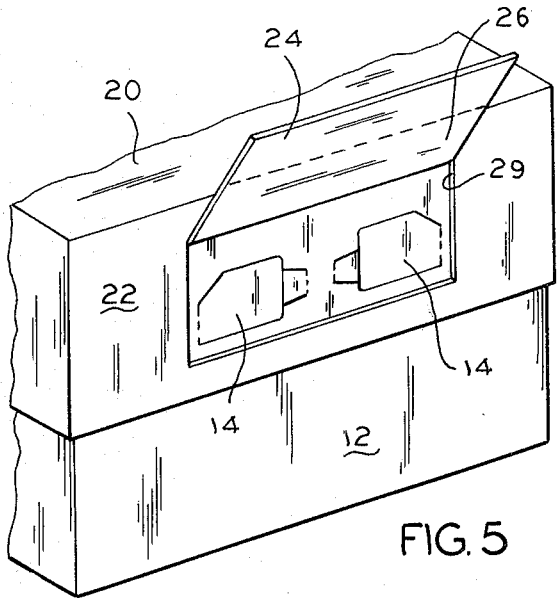
Figure 6:
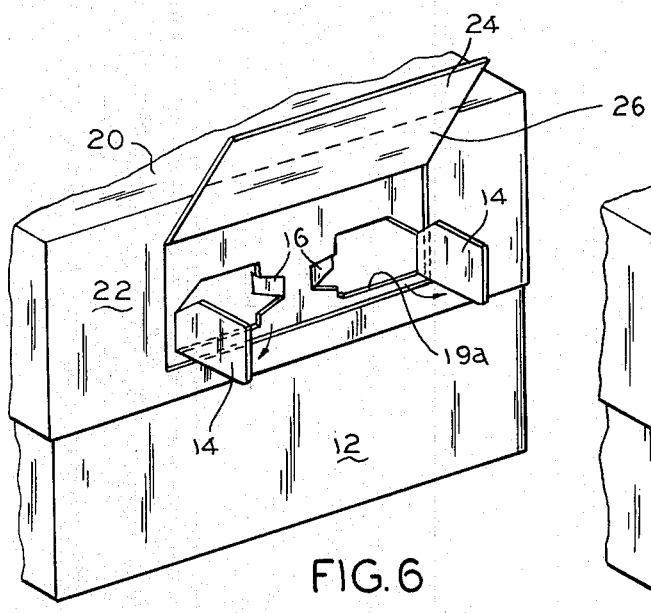
Figure 7:
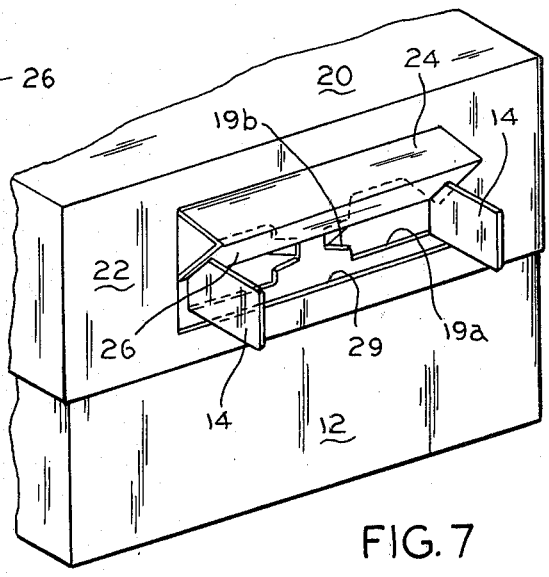
Figure 8:
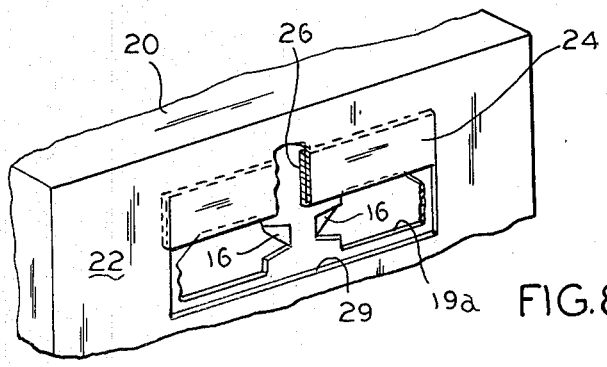

Referring now to the drawings for a better understanding of the invention, it will be seen that the tray and cover portions of the container, indicated generally at T and C, respectively in FIG. 3, may be formed from unitary blanks TB and CB, respectively, illustrated in FIGS. 1 and 2.

The tray portion of the container includes a bottom wall 10 having at least one side wall 12 foldably joined to a side edge thereof on a fold line 13 and disposed to extend upwardly therefrom and normal thereto. Side wall 12 is provided with a pair of lock tabs 14 located adjacent each other and defined by cut lines 15*a* and fold lines 15*b* which foldably join the lock tabs to the side wall.

Side wall 12 is also provided with a pair of access tabs 16 located adjacent respective lock tabs 14. Each of the access tabs is defined by a cut line 16*a*, a portion of the adjacent cut line 15*a* of the related lock tab, and a fold line 16*b* which foldably joins the access tab to side wall 12.

Thus, it will be seen that when lock tabs 14 are moved out of the plane of side wall 12 vent openings 19*a* are provided. Also, when access tabs 16 are pushed inwardly from the plane of side wall 12 access openings 19*b* are provided which enable a finger to be inserted through the access opening to pull out the lock tab.

Now turning to the cover portion of the container, it will be seen that the cover C includes a top wall 20 having a side wall 22 foldably joined on fold line 23 to a side edge of the top wall and disposed to extend downwardly therefrom and normal thereto.

Cover side wall 22 includes a pair of first and second vent cover flaps 24 and 26 which are disposed in alignment with the previously described lock tabs 14. First vent cover flap 24 is defined by a pair of spaced cut lines 25*a*, a fold line 25*b* which joins first vent cover flap 24 to cover side wall 22, and a second fold line 27*b*.

Second vent cover flap 26 is defined by a generally U-shaped cut line 27*a* and the previously referred to fold line 27*b* which foldably joins second flap 26 to first flap 24. It will be seen that when the first and second flaps are moved outwardly from the plane of cover side wall 22 an opening 29 is provided which is aligned with previously mentioned vent openings 19*a* in the tray portion to permit air to pass through the side walls of the tray and cover portion of the container.

It will be noted that previously mentioned fold line 25*b*, which joins first vent cover flap 24 to side wall 22, is actually a line of weakness which permits flaps 24 and 26 to be detached completely from the tray cover if desired.

If it is not desired to utilize the venting feature of the container, the lock tabs, access tabs, and vent cover flaps can be left in place so that the side walls of both the tray and cover are solid and uninterrupted.

When it is desired to vent the container, after the cover has been placed on the tray, the vent cover flaps 24 and 26 are lifted outwardly to provide access to the side wall tray. At this point the access tabs 16 may be pushed in and the lock tabs 14 pulled out to provide the vent openings 19*a* in the tray side wall. The first and second cover flaps are then folded outwardly from the cover side wall and at an angle to each other with the lower edges of second vent cover flap 26 being engaged with the lock tabs 14 to maintain the vent cover flaps in open position.

Thus it will be seen that the invention provides a relatively economical and yet practical venting arrangement which offers alternative arrangements for utilizing the container in a non-vented condition or a vented condition.

After the container tabs and flaps have been moved to the venting position, if it is desired to reuse the container they may of course be returned to the closed position.

I claim:

1. A venting arrangement for a container having telescoping tray and cover members, comprising;

(a) a tray member having at least one side wall including:

(i) a pair of lock tabs formed from material of said side wall and foldably joined thereto on vertical axes for movement outwardly from the plane thereof to provide vent openings therein;

(ii) a pair of access tabs formed of material of said side wall and foldably joined thereto on vertical axes for movement inwardly from the plane thereof to provide openings for finger access to said lock tabs;

(b) a telescoping cover member having at least one side wall disposed outwardly adjacent said tray member side wall and having a cover flap formed from material of said cover member side wall adjacent said tray member lock tabs and including:

(i) a first section foldably joined to said cover member side wall on a horizontal axis;

(ii) a second section foldably joined to said first section on a horizontal score line;

(iii) said sections being foldable outwardly from the plane of said cover member side wall and into converging planes to expose said tray member side wall vent openings when said lock tabs are folded outwardly at an angle of 90° to said tray member side wall, said lock tabs being disposed in a parallel and spaced apart relationship;

(c) said first and second sections being foldable at an angle to each other, lower edges of said second section being disposed within the side wall vent openings and being securely engageable with said tray member lock tabs to maintain said cover flap in open position.

2. The venting arrangement as claimed in claim 1 wherein said second section of said cover flap is foldable at an angle of 180° about said horizontal score line to lie in face-to-face relationship with said first section.

3. The venting arrangement as claimed in claim 1 wherein said tray member lock tabs are completely removable from said tray member side wall for continuous ventilation.

* * * * *